United States Patent [19]

Gustafson et al.

[11] 4,172,755

[45] Oct. 30, 1979

[54] SPLICING SHEET MATERIAL

[75] Inventors: Stanley Gustafson; Anthony J. Sissons, both of Croydon, England

[73] Assignee: Interfic Engineering Limited, London, England

[21] Appl. No.: 773,785

[22] Filed: Mar. 2, 1977

[30] Foreign Application Priority Data

Mar. 3, 1976 [GB] United Kingdom ..... 8538/76

[51] Int. Cl.[2] ..... B65H 21/00

[52] U.S. Cl. ..... 156/504; 156/502

[58] Field of Search ..... 156/504, 505, 502, 250, 156/251, 252, 507; 242/58.1, 58.3, 58.4; 83/620, 839

[56] References Cited

U.S. PATENT DOCUMENTS

| | | | |
|---|---|---|---|
| 3,061,220 | 10/1975 | Gagg et al. | 156/504 |
| 3,593,611 | 7/1971 | Sagehorn | 83/620 |
| 3,880,698 | 4/1975 | Kawazura et al. | 156/504 |
| 3,886,030 | 5/1975 | Hurst | 156/504 |

*Primary Examiner*—John T. Goolkasian
*Assistant Examiner*—William H. Thrower
*Attorney, Agent, or Firm*—Bruce G. Klaas

[57] ABSTRACT

A method and apparatus for splicing the lead end of a full roll of sheet material to the terminal end of a depleted roll of sheet material comprising first and second pairs of material engageable roller members, each pair of roller members being relatively movable between a spaced open loading position and an adjacent splicing position; and each pair of roller members being spaced from the other pair of roller members a relatively short distance defining a splicing cavity therebetween; a splicing table mounted for movement relative to the roller members within the splicing cavity between a loading position and a splicing position, the loading table supporting the lead end of the new roll with one adhesive surface of a double backed adhesive strip of material attached to the lead end; operating means to move the loading table to the splicing position and to move the roller members to the splicing position to effect attachment of the lead end of the new roll to the terminal end of the depleted roll by adhesion of the other adhesive surface of the double backed adhesive strip to the terminal end of the depleted roll; and knife means effective, after attachment of the lead end of the new roll to the terminal end of the depleted roll, to sever the terminal end of the depleted roll.

29 Claims, 16 Drawing Figures

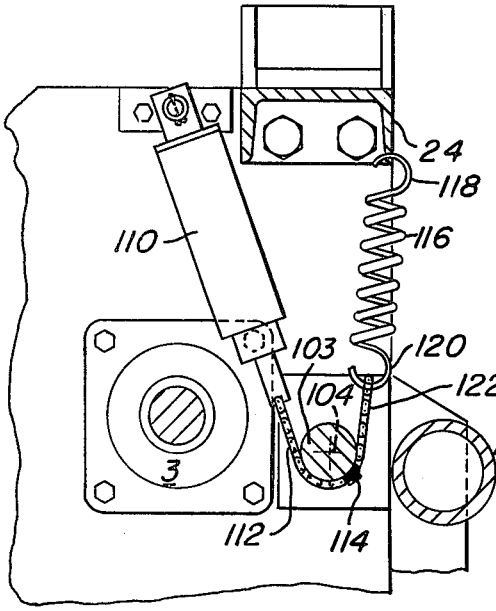
Fig-10
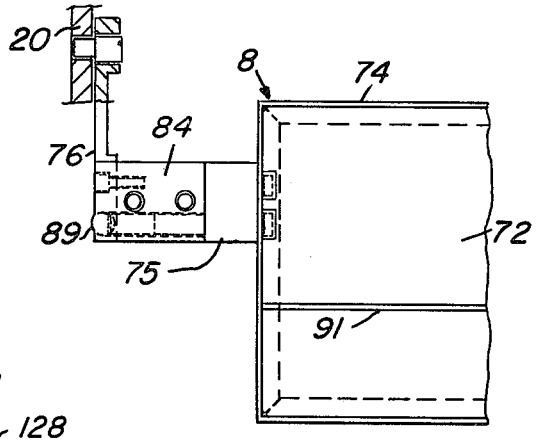
Fig-11
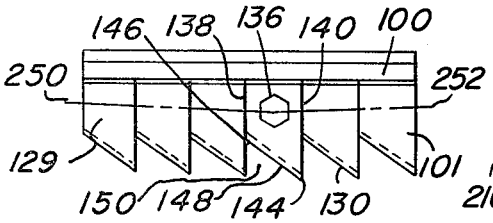
Fig-12
Fig-13
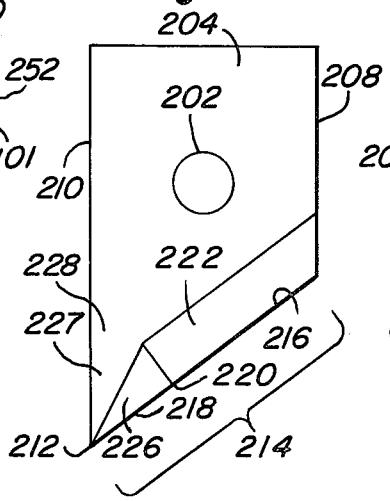
Fig-14
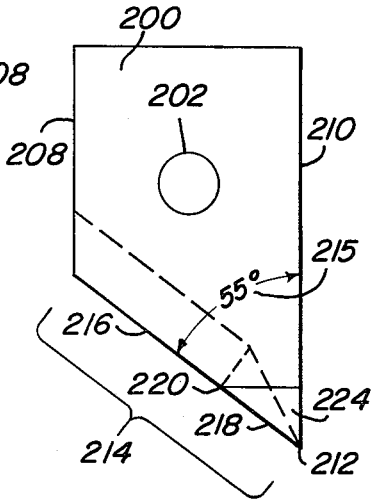
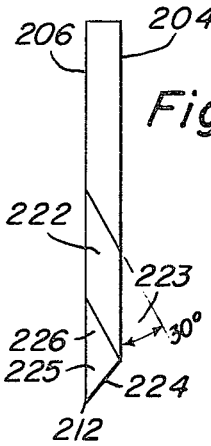
Fig-15
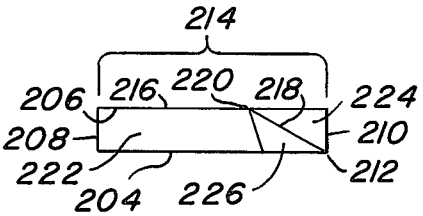
Fig-16

SPLICING SHEET MATERIAL

BACKGROUND AND SUMMARY OF THE INVENTION

The present invention relates to splicing sheet material and has particular, but not exclusive, application to splicing paper, especially for use in the manufacture of corrugated board.

At the present time the paper feed into corrugating machinery is from reels of, for example 2 to 3 tons weight and in order to maintain continuity of feed two special arrangements have been devised to splice the end of an exhausting reel to the start of a replacement reel. In one commonly adopted arrangement (the so-called "flying splice"), the peripheral speed of a replacement reel is brought up to the speed of the paper being fed from the exhausting reel and the splice effected when the said speeds are substantially equal. In the other commonly adopted arrangement (the so-called stationary splice), the inlet path followed by the paper feed is variable in length so that paper at commencement of said path can be momentarily reduced to a stationary state without varying the speed of paper at the termination of the path. Usually, said path is of a zig-zag configuration with the apices defined by idler rollers arranged in two relatively movable sets to vary the length of the inter-apices sections of the path.

Neither of the said arrangements is satisfactory in that it involves costly equipment and/or requires substantial operator skill to ensure a good splice. It is an object of this invention to provide a relatively inexpensive arrangement suitable for splicing paper for feeding to corrugating machinery which is operable reliably by relatively unskilled operatives.

According to the present invention, there is provided a method of splicing stationary sheet material to moving sheet material which comprises providing on a portion of a face of the stationary sheet material adhesive means for adhering said sheet materials together, aligning said portion in opposed relationship with the moving sheet material at a position along the path thereof, bringing the said sheet materials into frictional engagement so that the moving sheet material drives the previously stationary sheet material and pressing the said sheet materials together downstream of said position to sandwich the adhesive means between the sheet materials.

The method of the invention has particular use in splicing together webs of paper, especially for use in corrugating machinery, where the stationary web is stored on a replacement reel and the moving web is being drawn from an exhausting reel. In the corrugating application the replacement reel weighs as much as 3 tons and it has previously been assumed that a splice could not be made between a moving web portion and a stationary web end from the replacement reel. The present invention permits such a splice to be readily made with the moving web travelling at a speed of up to 25 meters per minute. If desired or in some cases necessary, the stationary reel can be given an initial spin simultaneously with the frictional engagement of the webs to overcome or at least reduce the inertia of the reel to rotation in response to movement of the web thereof. Other means of reducing the strain upon the stationary web upon commencement of movement thereof can alternatively or additionally be provided. For example, a path of variable length can be provided between the stationary reel and the splice position in similar manner to that used in stationary splicing as described above.

It will be appreciated that when reference is made in this specification to the "stationary" sheet material etc., that material etc. which was stationary at commencement of the splicing operation is meant although the material etc. may be moving at the time to which the reference refers.

The method can be used to under or over splice as required and when consecutive splicing operations are carried out under splicing can alternate with over splicing.

It is preferred that cutting means are operated simultaneously with frictional engagement of the sheet materials to sever the moving sheet upstream of the position of such engagement.

Suitably, the sheet materials are frictionally engaged by pressing them together in the nip between two relatively movable idler-rollers. The means moving said rollers can also serve to operate the cutting means if present. The means pressing the sheet materials together to sandwich the adhesive means between them can also comprise the nip between two idler rollers which can be in fixed spatial relationship. It is presently preferred that the adhesive means is double sided adhesive tape, which tape is known for its use in conventional flying and stationary splicing. However, other adhesive means such as one sided adhesive tape and liquid adhesives or the like may also be employed.

The invention also provides apparatus for carrying out the method of the present invention, which apparatus comprises locating means for aligning the said portion of the stationary sheet material in opposed relationship with the moving sheet material at a position along the path thereof; drive means for bringing the said sheet materials into frictional engagement so that the moving sheet material drives the previously stationary sheet material; and pressure means located downstream of said position to sandwich the adhesive means between the sheet materials.

Preferably, the drive means and pressure means are idler rollers as referred to above with reference to the method of the invention. It is also preferred that cutting means are provided upstream of the splicing position to sever the moving sheet and that said means is operated simultaneously with the drive means when the latter brings the sheet materials into frictional engagement. Usually, the drive means will be upstream of the splicing position and the cutting means upstream of the drive means.

The locating means in the case of apparatus adapted for oversplicing can comprise a stationary guideplate preventing upward movement of the stationary sheet material during the splicing operation. In the case of apparatus adapted for under splicing, said means can include a support plate for supporting the stationary sheet material below the moving sheet material. Suitably, said plate is pivotally mounted for movement to an inoperative attitude to facilitate, for example, cutting of the stationary sheet material to a desired length and/or location of the adhesive means on said material.

The splicing apparatus and method is of relatively simple and inexpensive construction so as to avoid the use of highly skilled maintenance personnel. It is relatively compact and may be readily incorporated in existing paper sheet corrugating installations without requiring expensive modifications or additional equipment. The apparatus is pneumatically operated by standard factory compressed air supply and only two manually operable push button type electrical controls are utilized, one for slow-down of the corrugator apparatus and the other for initiating operation of the splicer apparatus. The actual operation of the apparatus is fully pneumatic without use of electric motors and electronic control circuits. Thus, the splicer apparatus is easy to operate and does not require a highly skilled operator. The splice preparation procedure is relatively simple and straight line threading is employed to reduce preparation time. The splicing apparatus may be operated automatically or remotely at a central control station. The apparatus has the additional advantages of enabling consistent good splices with minimum waste. The length of the tail on the depleting roll may consistently be kept at a length of from 8 to 10 inches so as to enable each paper roll to be substantially completely utilized. The apparatus requires minimal maintenance involving only lubrication and cleaning. In addition, the knife blade assembly comprises a series of individual blades of new design for maximum cutting efficiency and easy individual blade replacement.

BRIEF DESCRIPTION OF THE DRAWINGS

FIG. 10 is a partial cross-sectional end elevational view taken along line 10—10 in FIG. 7;

FIG. 11 is a partial end view of a portion of the apparatus of FIG. 8 taken in the direction of the arrow 11 in FIG. 8;

FIG. 12 is an enlarged partial side elevational view of the knife means of FIG. 8.

FIG. 13 is a rear side elevational view of an alternative form of a knife member;

FIG. 14 is a front side elevational view of the knife member of FIG. 13;

FIG. 15 is a side elevational view of the knife member of FIGS. 13 and 14; and

FIG. 16 is a bottom view of the knife member of FIGS. 13-15.

DETAILED DESCRIPTION OF THE INVENTION

In General

Figure 1:
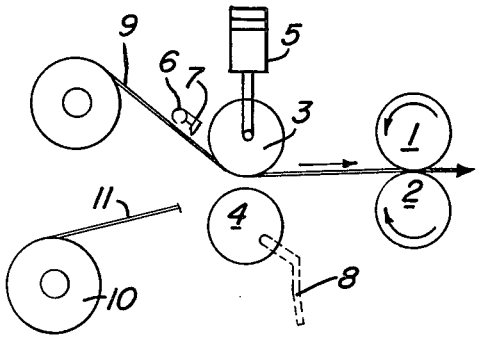
FIG. 1 is a diagrammatic view of a paper infeed to a corrugating machine which infeed incorporates apparatus in accordance with the present invention and is shown in its normal running conditions.
Figure 2:
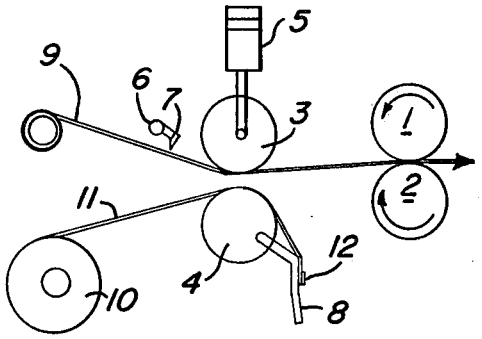
FIG. 2 is a diagrammatic view corresponding to that of FIG. 1 and showing a replacement web under preparation for splicing to the running web.
Figure 3:
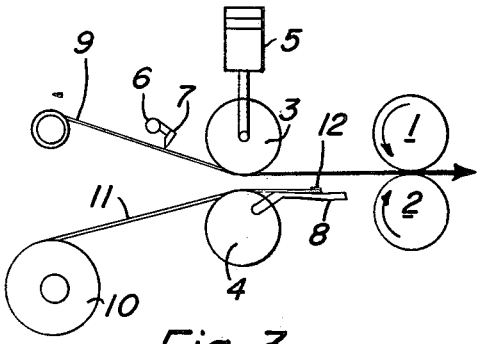
FIG. 3 is a diagrammatic view corresponding to that of FIG. 2 and showing the replacement web at commencement of the splicing attitude.
Figure 4:
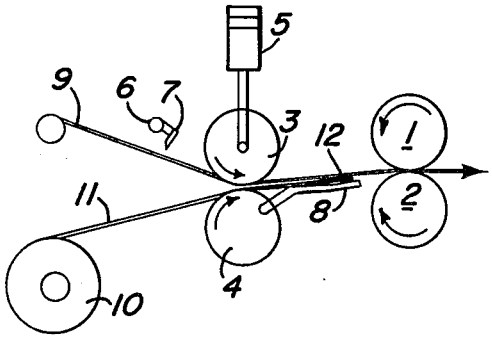
FIG. 4 is a diagrammatic view corresponding to that of FIG. 3 and showing the webs at an intermediate time in the splicing operation.
Figure 5:
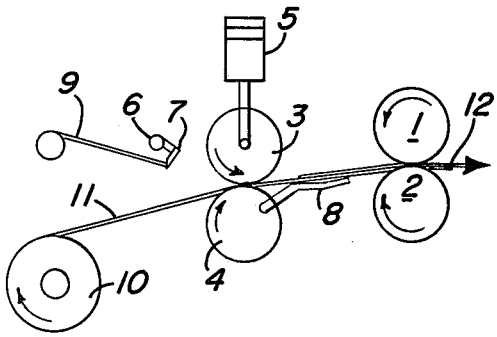
FIG. 5 is a diagrammatic view corresponding to that of FIG. 4 and showing the webs at termination of the splicing operation.

Referring to FIGS. 1-5 of the drawings, splicing apparatus in accordance with an embodiment of the invention comprises a first pair of roller means in the form of idler rollers 1, 2 defining between them a web-receiving nip. Upstream of said rollers 1, 2 are located a second pair of roller means in the form of drive idler rollers 3, 4 of which roller 3 is movable vertically by a pneumatic cylinder 5 and roller 4 is fixed. Conveniently rollers 1, 2, 3 and 4 are made of steel. A guide bar 6 and knife means in the form of a pivoted cutting knife 7 are disposed sequentially upstream of roller 3. Knife 7 is arranged to operate a predetermined time after lowering of roller 3 into its lowest position. Guide plate means, in the form of a guide plate or table 8 is mounted for pivotal movement about the axis of roller 4 between a vertical attitude (as shown in FIGS. 1 and 2) and a horizontal attitude (as shown in FIGS. 3, 4 and 5).

In normal operation (shown in FIG. 1) a web of paper 9 from an exhausting reel (not shown) mounted on a rotatable mill roll stand (also not shown) is fed under bar 6 and roller 3 to pass between rollers 1, 2 to be drawn into a corrugating machine (not shown). The mill roll stand carries a replacement roll 10 which is mounted on the stand whilst the web from the exhausting reel is being drawn into the machine. The leading end of the web 11 on reel 10 is passed over roller 4 to be against guide plate 8 and is cut to a desired length indicated by a mark on said plate. Means (not shown) are provided to prevent web 11 from falling off the roller 4. For example retention rollers can be provided upstream of roller 4. Double sided adhesive tape 12 is then connected to the face of the end of the web 11 remote from guide plate 8. This condition is shown in FIG. 2.

The guide plate 8 is pivoted to its horizontal position as shown in FIG. 3 whence the end of web 11 is located in spaced parallel relationship to moving web 9. When a splice is to be made, roller 3 is lowered causing webs 9 and 11 to frictionally engage whereby web 9 drives web 11 forwardly and up an inclined surface at the downstream end of guide plate 8 which provides guide means for establishing an upwardly inclined intersecting path of movement for web 11 relative to web 9. The condition at commencement of engagement is shown in FIG. 4.

The forward movement of the webs 9, 11 causes them to pass together through the nip between rollers 1 and 2 thereby sandwiching the tape 12 between the webs to effect the splice. Simultaneously or shortly thereafter, knife 7 is pivoted to sever web 9 leaving web 14 to supply the corrugating machine. The mill roll stand is then rotated to bring reel 10 to the position previously occupied by the exhausting reel whereby said exhausting reel can be removed and replaced by a fresh reel which then occupies the position of reel 10 shown in FIGS. 1-5.

Embodiments of FIGS. 6-12

Referring now to FIGS. 6-12, a presently preferred embodiment of the apparatus of FIGS. 1-5 is shown to comprise a pair of opposite end plate support members 20, 22 connected by two elongated support beam members 24, 26 adapted to be fixedly mounted on overhead support means (not shown) by four vertical support beam members 28, 30, 32, 34.

Idler rollers 1, 2 and drive idler rollers 3, 4 are mounted on end plate members 20, 22 and extend therebetween. The rollers have equal diameters and the axes of rotation 36, 38 of rollers 3, 4 and the axes of rotation 40, 42 of rollers 1, 2 are vertically aligned in the operative positions shown in FIG. 8. However, the axes 40, 42 of rollers 1, 2 are vertically upwardly offset relative to the axes 36, 38 of rollers 3, 4 as indicated at 44, 46 for a purpose to be hereinafter described. The horizontal distance between axes 36, 38 and axes 40, 42 is only approximately 14 inches to provide a relatively short length splicing cavity 47 therebetween. A cylindrical guide tube member 48 extends between end plates 20, 22 and has a web holding means 49 mounted at each end thereof.

Figure 8:
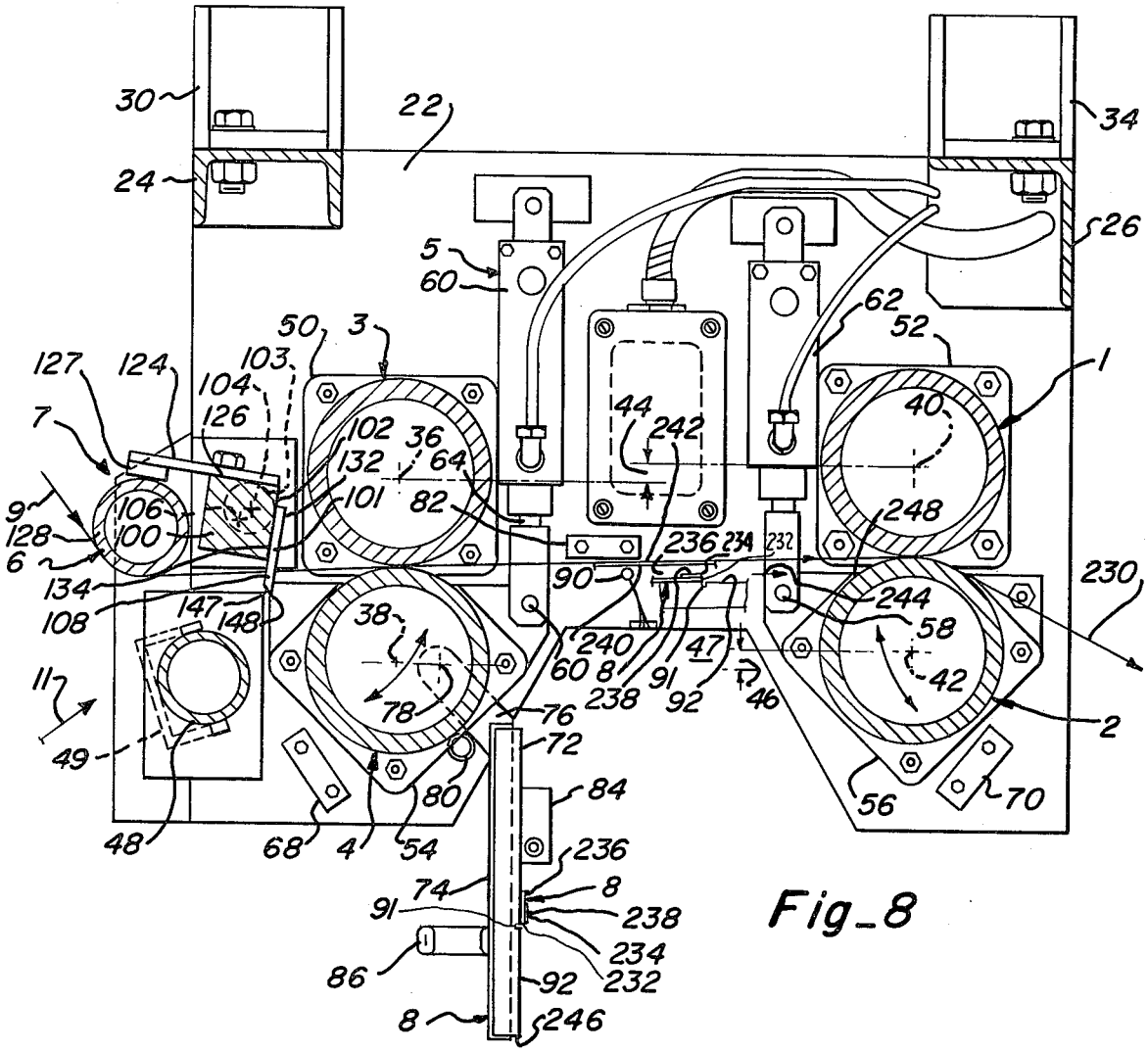
FIG. 8 is a partial cross-sectional end elevational view of the apparatus of FIGS. 6 and 7 taken along the line 8—8 in FIG. 7.

Rollers 1 and 3 are rotatably supported by bearing plate means 50, 52 fixedly mounted on end plate members 20, 22 whereas rollers 2, 4 are rotatably mounted on bearing plate means 54, 56 pivotally mounted on the end plate members 20, 22 for pivotal movement about pivot axes 58, 60 between an inward operating position in juxtaposition to corresponding rollers 1, 3, as shown in FIG. 8, and an outward non-operating position in outwardly spaced relationship to the corresponding rollers 1, 3, not shown. Air operated cylinders 60, 62 mounted on end plate member 22 are operably connected by suitable linkage means 64, 66 to bearing plate means 54, 56 for selectively causing pivotal movement of rollers 2, 4, and stop block means 68, 70 may be provided on end plate members 20, 22 to limit outward movement.

The guide plate means 8 comprises an elongated table member 72 of rectangular cross-section, which may be made of relatively lightweight material such as wood, supportively mounted in a table frame means 74 fixed at each end by a bracket 75 to pivotal link means 76 pivotally mounted on the side plates 20, 22 for pivotal movement about pivotal axis 78 from an outward loading position, FIG. 8, and an inwardly displaced splicing position (not shown). A stop rod means 80 and a stop block means 82 mounted on each of the side plate members 20, 22 are engageable, respectively, with link means 76 in the loading position and with a stop block means 84, mounted on each end of the frame means 74, in the splicing position. A pair of suitably spaced and positioned handle members 86 are mounted on the back surface 88 of the table member to enable manual positioning thereof and suitable latch means 89 in the form of a spring loaded ball detent member, FIG. 11 are provided to releasably engage a slot 90, FIG. 8, in the side plates and hold the table member in the splicing position. An elongated groove 91 extends from end to end of the front working surface 92 of the table member 72.

The cutting knife means 7 comprises an elongated rotatable knife bar member 100, of square cross-sectional configuration, having knife blade means 101 fixedly attached along one side surface 102 thereof. The knife bar member 100 extends between end plates 20, 22 and is fixedly mounted on rotatable end shaft means 103 rotatably supported by the end plates to provide an axis of rotation 104 which is eccentric to the central axis 106 of the knife bar member 100. Knife bar operating means, FIG. 10, in the form of an air cylinder 110 operably connected to a length of chain 112 fixed to a reduced diameter portion of the shaft means 103 at 114 and a tension spring member 116 connected at one end 118 to the frame member 24 and at the other end 120 to a length of chain 122 fixed to the shaft means at 114, are provided to rotate shaft means 103 about axis 104 and move the knife bar member 100 and knife blade means 101 between an outward inoperative position, FIG. 9, and an inward cutting position, FIG. 8. A stop means, in the form of a bracket arm member 124 mounted on side surface 126 of bar member 100 and carrying a stop block member 127, engageable with the guide bar means 6, in the form of an elongated tube member 128 extending between end plates 20, 22, is provided to locate the knife bar member 100 and knife means 101 in the operative cutting position, FIG. 8.

As shown in FIGS. 8 and 12, a presently preferred form of knife means 101 comprises a plurality of individual knife members 129 of generally rectangular peripheral and cross-sectional configuration with pointed tapered inclined outer cutting surface means 130. Each knife member comprises relative wide parallel front and back side surfaces 132, 134, FIG. 8, with back side surface 134 being mounted in abutting supportive engagement with knife bar side surface 102 by suitable fastening means 136. Relatively narrow width parallel side edge surfaces 138, 140, FIG. 12, are adapted to be mounted in close fitting abutting engagement with the side edge surfaces of next adjacent knife members. The cutting surface means 130 of each knife member comprises a flat surface 147, FIG. 8, which is tapered and inclined relative to side surfaces 132, 134, so as to extend outwardly and forwardly relative to the direction of movement of the roll paper, and which is tapered and inclined relative to side surfaces 138, 140, FIG. 12, so as to terminate at one end in an outermost sharp penetrating point 144 and to terminate at the other end at an innermost location 146 defining an inclined sharp slicing edge 148 extending along a slicing gap 150 between adjacent penetrating points 144 of adjacent knife members. The aforedescribed knife construction and arrangement is particularly useful for cutting of relatively heavy paper without tearing as has been a problem with prior art devices.

While the foregoing knife construction provides exceptionally good results for most kinds and weights of sheet materials, relatively heavy weight sheet materials, such as kraft liner board, are better cut by a blade of the design of FIGS. 13 to 16, which comprises a blade member 200 having a mounting hole 202, front and rear surfaces 204, 206, parallel side surfaces 208, 210, a piercing point 212 and a cutting edge 214 which is inclined relative to side wall surfaces 208, 210 at an included angle of approximately 55° as indicated at 215 shown in FIG. 14.

The cutting edge 214 comprises a first innermost portion 216 and a second outermost portion 218 which intersect at 220. Cutting edge portion 216 is defined by the intersection of a first flat inclined surface 222 of quadrilateral configuration which intersects and extends between front and back surfaces 204, 206 at an included angle of approximately 30° as indicated at 223 in FIG. 15. Cutting edge portion 218 is defined by the intersection of a second flat inclined surface 224 of triangular configuration, which intersects and extends between front and back surfaces 204, 206 at an included angle of approximately 30° to provide a triangular shape tip surface portion on the outer end of side surface 210 as indicated at 225, FIG. 15, and a third flat inclined surface 226 of triangular configuration which intersects side surface 210 at an included angle of approximately 30° as indicated at 227, FIG. 13, to define a triangular shape tip surface portion 228 at the outer end of front surface 204.

The piercing point 212 is defined by the intersections of the four triangular shape flat outer surfaces 224, 225, 226, 227 to provide a truncated (pyramidal) piercing means for piercing the sheet material, establishing an initial direction of cutting along a first cutting edge portion 218, and then changing the direction of cutting along a second cutting edge portion 216 whereby to overcome the resistance of relatively heavy high strength sheet material to the cutting action. It is to be noted that the blade design of FIGS. 8 and 12 is specifically different than the blade design of FIGS. 13–16 in that the cutting edge 130 of the blade design of FIGS. 8 and 12 is on the front surface 132 (i.e., the surface facing the direction of travel of the sheet) whereas the cutting edge 214 of FIGS. 13–16 is on the back surface 206 (i.e., the surface facing opposite of the direction of travel of the sheet).

Figure 9:
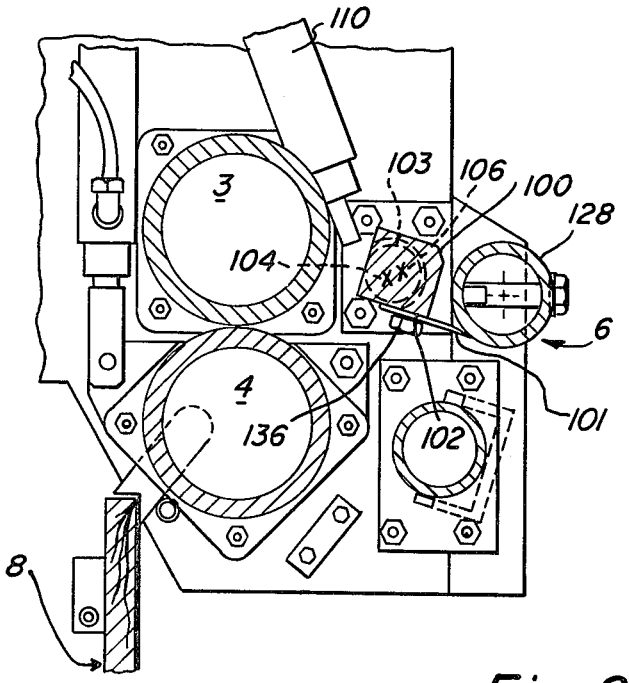
FIG. 9 is a partial cross-sectional end elevational view of the apparatus of FIGS. 6 and 7 taken along line 9—9 in FIG. 7.

In operation of the apparatus of FIGS. 6–16, during normal unwinding of the sheet material 9 prior to a splicing operation, the knife means 7 is located in the outward upwardly displaced inoperative position of FIG. 9, by the spring means 116, FIG. 10; the roller 4 is located in the outward downwardly displaced position (as generally illustrated in FIGS. 1–3) with plate 54 supported on abutment block 68; the roller 2 is located in the outward downwardly displaced position (not shown) with plate 56 supported on abutment block 70; and the table means 8 is located in the outward downwardly displaced position of FIG. 8.

It is noted that in the event of power failure or loss of air pressure, the knife means 7 will be returned to and positively held in the inoperative position by the spring means 116, FIG. 10, and the rollers 2, 4 will be returned to and positively held in the inoperative positions by gravity. Thus, an important advantage of this arrangement is that each part of the apparatus operable during a splicing operation is normally positively located in the inoperative position whereby to preclude accidental movement toward the operative positions upon any system failures such as loss of air pressure and overcome safety problems of certain prior art arrangements. During normal unwinding, the sheet material 9 extends downwardly from the roll of material as generally illustrated in FIGS. 1–4 & 8 at a suitable angle of, for example, approximately 30° toward and engages the bottom surface of guide tube 128; across the splicer cavity 47 in upwardly spaced relationship to the upper surface of roller 4, as generally shown in FIGS. 1–3; engages the upper surface of roller 2 in downwardly spaced relationship to roller 1; and extends downwardly from roller 2 in the direction of the arrow 230, FIG. 8.

In order to prepare for the splicing operation, the lead edge of a new roll of material 10 is pulled over the upper surfaces of guide tube 48 and roller 4 beneath and in downwardly spaced relationship to the moving sheet of material 9 as generally illustrated in FIG. 1. The lead edge is pulled downwardly along table surface 92 beyond cutting groove 91 and then trimmed to leave a straight lead edge 232 extending along the groove 91. A strip of double backed adhesive tape material 12 (FIGS. 2–4), and 234 (FIG. 8) is secured along the lead edge 232. The side edges of the sheet 11 of the new roll are aligned with the side edges of the sheet 9 of the old roll and engaged with the spring loaded holder devices 49, FIG. 8, on guide tube 48 to maintain the alignment. Then, the table means 8 is moved upwardly to and latched in the splicing position, as illustrated in FIGS. 4 & 8 with stop block means 84 at each end engaging stop block means 82 to locate the upper surface 236 of the lead portion of the new roll 10 supported on table surface 92 and the upper adhesive surface 238 of the splicing tape in relatively closely spaced proximity to the lower surface 240 of the adjacent portion 242 of the moving sheet material 9. The arrangement of table surface 92, link 76, and pivotal axis 78 is such that the lead edge 232 of the new material and the adhesive strip 238 move outwardly in the direction of arrow 244, FIG. 8, along surface 92 toward the outer edge 246 of the table 72 so that, in the splicing position, the lead edge 234 and adhesive tape 234 are located in relatively close proximity to the surface 248 of roller 2.

Figure 6:
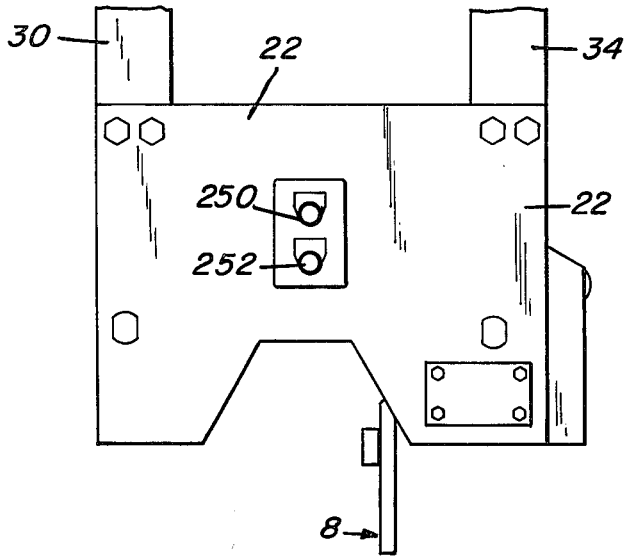
FIG. 6 is an end elevational view of a presently preferred embodiment of the apparatus of FIGS. 1-5.
Figure 7:
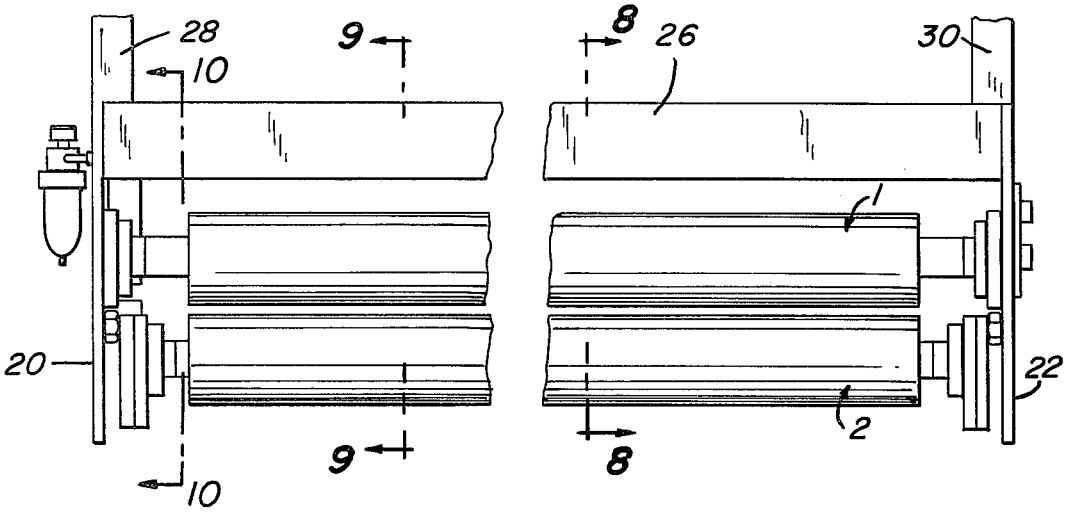
FIG. 7 is a side elevational view of the apparatus of FIG. 6 taken in the direction of arrow 7 of FIG. 6.

Just before the splicing operation is initiated, the speed of movement of the sheet material 9 is reduced to a relatively slow splicing speed by actuation of a control button 250, FIG. 6, which actuates conventional speed control apparatus (not shown). In order to initiate the splicing operation, the operator actuates a control button 252, FIG. 6, whereupon compressed air is delivered to air cylinder 62 at a relatively fast rate resulting in rapid upward pivotal movement of roller 2 a relatively short distance, as indicated by the spacing between plate 56 and stop 70, FIG. 8, to the position of engagement with roller 1 with the sheet material 9 on roller 2 being upwardly displaced to provide guide means which establish an upwardly inclined path of movement of the sheet material 9 from the guide tube 128 and roller 3 to the rollers 1, 2 which are caused to rotate by frictional engagement under pressure with the moving sheet of material 9.

Compressed air is also delivered to air cylinder 60 at a relatively slow rate causing the roller 4 to be somewhat more slowly pivotally upwardly displaced a relatively long distance, as indicated by the spacing between plate 54 and stop 68, FIG. 8, to the position of engagement with roller 3 a relatively short time, e.g., one second or less, subsequent to engagement of roller 2 with roller 1. The upward movement of roller 4 causes upward movement of the portion of the new roll of sheet material supported thereon and engagement of the upper surface of the new sheet material portion with the lower surface of the relatively slowly moving sheet material 9. In this manner, movement of the new roll of sheet material is initiated by frictional contact with the moving sheet material 9 maintained by the pressure of the rollers 3, 4 and supplemented by the rotation of rollers 3, 4 caused by frictional engagement under pressure with the sheet materials 9, 11. The movement of the new sheet material 11 results in forward movement of the lead edge 232 onto the upper portion 248 of the surface of rotating lower roller 2 and upward movement toward the lower surface 240 of sheet 9 and the lower surface of upper roller 1 to cause the upper adhesive surface 238 of the splicing tape 234 to engage the lower surface 240 of sheet 9 just prior to passage between rollers 1, 2 whereat the pressure of the rollers firmly adhesively connects the moving sheet 11 to the moving sheet 9.

Shortly after the adhesive connection has been effected, compressed air is delivered to knife operating air cylinder 110, FIGS. 9 & 10, through suitable time delay means (not shown) to pull chains 112, 122 against the bias of spring means 116 and cause rapid rotation of shaft portions 103, knife bar 100, and knives 101 or 200 from the retracted position to the cutting position. The construction and arrangement of the knives is such that the piercing points 144 or 212 make initial contact with the upper surface of sheet 9 at a rearwardly downwardly inclined angle during the movement of the knives from the retracted position to the final cutting position whereat stop 127 engages tube 128. In addition, as the movement of the knives continues after the initial contact, the included angle between side surfaces 132 or 204 of the knives and the plane of the sheet 9 therebelow gradually increases as the point of contact between the inclined cutting edges 148 or 214 of the knives and the sheet 9 moves laterally away from the piercing points 144 or 212 toward the short side surfaces 138 or 208. The result is that a relatively clear sharp straight cut is made across the sheet 9 without discontinuous ripping, tearing and unraveling of the sheet material as caused by prior art devices. In a presently preferred embodiment, the knives 101 or 200 are mounted on the knife bar in slightly staggered offset relationship, as indicated by lines 250, 252, FIG. 12, so that the piercing points 144 or 212 of the centermost knife, indicated at 136, is located furthest outwardly relative to the piercing points of the other knives and contacts the center portion of the sheet before the other knives with subsequent contact with the piercing points of the other knives proceeding sequentially outwardly toward both side edges of the sheet 9.

After a relatively short time sufficient to enable the cutting knives to reach the full outward cutting position, the effective application of pressurized air to all the air cylinders is automatically terminated whereupon the spring means 116 is immediately effective to return the knife means 7 to the retracted position and the weight of rollers 2, 4 is effective to return them to their downwardly displaced positions. The operator may then manually return the table means 8 to the downwardly displaced loading position.

While the inventive concepts have been disclosed herein by reference to an illustrative embodiment thereof in which the splicing operation is effected beneath the sheet 9 (an under-splicing arrangement), it is to be understood that many of the inventive concepts are applicable to other kinds of splicing operations, including over splicing arrangements and over and under splicing arrangements, as will be readily apparent to those skilled in the splicing art. Thus, it is not intended that the appended claims be construed as limited to the illustrative embodiments herein disclosed except insofar as limited by the prior art.

What is claimed is:

1. Apparatus for splicing the terminal end portion of a continuously moving continuous length of a first sheet of material to the leading end portion of a continuous length of a second sheet of material comprising:

first and second spaced roller means having the first moving sheet extending therebetween for engaging both the first moving sheet and the second sheet and being rotatably frictionally driven by the first moving sheet and for causing frictional driving engagement of the first moving sheet with the second sheet and movement of the second sheet with the first moving sheet between the first and second spaced roller means;

operating means for effecting engagement of said first and second roller means with both the first moving sheet and the second sheet;

guide means for causing adhesive engagement between the first moving sheet and a strip of adhesive on the second sheet after movement of the second sheet is initiated by the frictional driving engagement with the first moving sheet;

a splicing cavity provided between said first and second roller means and the first sheet of material being movable thereacross; and a movable table means being located between said first and second roller means and being movable between a loading position spaced outwardly of the first sheet and a splicing position located closely adjacent the first sheet for supporting the lead end of the second sheet in close proximity to the first sheet and in close proximity to the second roller means in the splicing position and for guiding the lead end of the second sheet onto the second roller means after movement of the second sheet is initiated by the first roller means.

2. The invention as defined in claim 1 and wherein said operating means further comprising:

first operating means associated with the first roller means for effecting engagement of the first roller means with both the first moving sheet and the second sheet to initiate the splicing operation; and second operating means associated with said second roller means for effecting adhesive engagement of the lead end of the second sheet with the moving first sheet after movement of the second sheet is initiated by the first operating means.

3. The invention as defined in claim 2 and wherein:

the first roller means comprising a first pair of roller members mounted in parallel relationship;

one of the first pair of roller members being movable relative to the other one of the first pair of roller members between an open loading position in outwardly spaced non-engaging relationship relative thereto while being in outwardly spaced non-engaging relationship to the first moving sheet and a closed splicing position in inwardly spaced frictionally engaging relationship relative thereto while being in frictionally engaging relationship to the first moving sheet and the second sheet;

the second roller means comprising a second pair of roller members mounted in parallel relationship downstream of said first pair of roller members;

one of the second pair of roller members being movable relative to the other one of the second pair of roller members between an open position in outwardly spaced non-engaging relationship relative thereto while being in abutting supporting relationship to the first moving sheet and a closed splicing position in inwardly spaced frictionally engaging relationship relative thereto while being in frictionally engaging relationship to the first moving sheet member and receiving the lead end portion of the second sheet member after initiation of movement thereof by the first roller means.

4. The invention as defined in claim 3 and wherein the axes of rotation of the first roller means are offset from the axes of rotation of the second roller means to provide an inclined intersecting path of travel of the second sheet relative to the path of travel of the first moving sheet.

5. The invention as defined in claim 3 and further comprising:

an elongated knife supporting bar member extending across the moving sheet;

elongated knife mounting surface means on said bar member extending across the moving sheet;

bar member mounting means for rotatably movably mounting said bar member across the moving sheet for rotational movement from an inoperative position with said mounting surface means being inclined relative to the moving sheet to a cutting position with said mounting surface means facing generally in the direction of movement of the moving sheet;

knife mounting means associated with said bar member for mounting a plurality of individual members on said knife mounting surface means;

a plurality of individual knife members mounted in side by side relationship on said knife mounting surface means for piercing and cutting the moving sheet during movement of said bar member from the inoperative position to the cutting position; and bar member operating means for causing movement of said bar member between the inoperative position and the cutting position.

6. The invention as defined in claim 5 and wherein said bar member operating means comprising:

air cylinder means operatively connected to said bar member for moving said bar member from the inoperative position to the cutting position; and spring means operatively associated with said bar member for moving said bar member from the operative position to the inoperative position.

7. The invention as defined in claim 5 and wherein said mounting means comprising:

shaft means for providing an axis of rotation for said bar member; and said mounting surface means having an axis of rotation eccentrically located relative to said axis of rotation of said shaft means.

8. The invention as defined in claim 5 and wherein each of said knife members comprising:

front and rear spaced parallel surfaces;

a short length side surface and a long length side surface extending between and connecting said front and rear spaced parallel surfaces;

a cutting edge extending between and being inclined relative to said short length side surface and said long length side surface;

a piercing point at the intersection of said cutting edge and said long length side surface;

the short length side surface of each knife member except the end ones abutting the long side surface of the next adjacent knife member; and the long length side surface of each knife member except the end ones abutting the short side surface of the next adjacent knife member.

9. The invention as defined in claim 8 and wherein:

said short length side surface and said long length side surface being flat and parallel to one another.

10. The invention as defined in claim 8 and further comprising:

an inclined end surface extending between said front and rear parallel surfaces; and said cutting edge being defined by the intersection of said inclined end surface with one of said front and rear parallel surfaces.

11. The invention as defined in claim 8 and further comprising:

a first inclined end surface extending between said front and rear parallel surfaces and defining a first portion of said cutting edge; and a second inclined end surface extending between said front and rear parallel surfaces and intersecting said first inclined surface therebetween and defining a second portion of said cutting edge intersecting said first portion of said cutting edge.

12. The invention as defined in claim 3 and wherein:

the one of said first pair of roller members and the one of said second pair of roller members being mounted below the other ones of the pairs of roller members and being operable by gravity from the closed positions to the open positions.

13. The invention as defined in claim 11 and further comprising:

a third inclined end surface extending between said front and rear parallel surfaces and intersecting said second inclined end surface and intersecting said long length side surface; and said second portion of said cutting edge being defined by the intersection of said third inclined end surface and said second inclined end surface.

14. The invention as defined in claim 13 and wherein:

piercing point being defined by the intersections of said third inclined end surface and said second inclined end surface and said long length side surface and one of said front and rear spaced parallel surfaces.

15. The invention as defined in claim 14 and wherein:

said one of said front and rear surfaces facing said mounting surface on said bar member.

16. Apparatus for splicing one moving sheet of material to another sheet of material and comprising:

a first cooperative pair of elongated parallel roller means having cylindrical outer peripheral surfaces and a first pair of spaced parallel axes of rotation and being relatively movable between an open loading position with said outer peripheral surfaces spaced a substantial distance from one another and a closed splicing position with said outer peripheral surfaces in closely spaced adjacent cooperative relationship for receiving a first moving sheet of material therebetween and for receiving therebetween a second sheet of material in a non-moving condition in the open loading position in engagement with one of said cylindrical outer peripheral surfaces of one of said first pair of roller means and for effecting driving engagement of said second sheet of material with said first moving sheet of material in the closed splicing position for initiating movement of said second sheet of material with and generally parallel to and in the same direction as said first sheet of material;

a second cooperative pair of elongated parallel roller means, having cylindrical outer peripheral surfaces and a second pair of spaced parallel axes of rotation, and being mounted in parallel spaced relationship to said first pair of roller means and being located downstream thereof adjacent the path of parallel movement of said first moving sheet of material and said second sheet of material, and being relatively movable between an open loading position with said cylindrical outer peripheral surfaces thereof spaced a substantial distance from one another and a closed splicing position with said cylindrical surfaces thereof in closely spaced adjacent cooperative relationship, for receiving said first moving sheet of material therebetween in continuous engagement with one of said cylindrical outer peripheral surfaces thereof in both the open loading position and the closed splicing position and for receiving the second sheet of material after initiation of movement therefor with the first sheet of material and effecting adhesive connecting engagement of said second sheet of material with said first moving sheet of material in the closed splicing position during movement therebetween;

splicing table means cooperatively mounted between said first pair of roller means and said second pair of roller means, and having a sheet material support surface thereon, and being movable between a sheet loading position outwardly spaced from said first moving sheet of material and a splicing position located next adjacent said first moving sheet of material whereat said support surface extends generally parallel to and is located closely adjacent said first moving sheet of material, for stationarily supporting said second sheet of material in the sheet loading position with a strip of adhesive material applied thereon and for initially stationarily supporting said second sheet of material in generally parallel closely spaced relationship to said first moving sheet of material in the sheet splicing position and for movably guidably supporting said second sheet of material after initiation of movement of said second sheet of material with said first moving sheet of material and for guiding movement of said second sheet and the adhesive strip of material thereon to and between said second pair of roller means in the splicing position thereof and for effecting adhesive contact between the strip of adhesive material on said second sheet of material and said first moving sheet of material.

17. The invention as defined in claim 11 and further comprising:

elongated cutting means being mounted in parallel closely spaced relationship to said first pair of roller means and being located upstream thereof for severing said first moving sheet of material after initiation of movement of said second sheet of material and immediately after effecting adhesive engagement between said first moving sheet of material and said second sheet of material between said second pair of roller means.

18. The invention as defined in claim 17 and further comprising:

elongated guide means being mounted in parallel closely spaced relationship to said elongated cutting means and being located upstream thereof for guiding said first moving sheet of material toward and between said first pair of roller means and for supporting said first moving sheet of material relative to said first pair of roller means and said cutting means.

19. The invention as defined in claim 18 and wherein said elongated guide means comprising:

a cylindrical outer peripheral surface being engageable with said first moving sheet of material and being positioned relative to said first pair of roller means so as to establish a path of movement of said first moving sheet of material between said elongated guide means and said first pair of roller means generally parallel to the path of movement of said first moving sheet of material between said first pair of roller means and said second pair of roller means.

20. The invention as defined in claim 19 and wherein said cutting means comprising:

pivotal support means having an elongated pivotal axis extending parallel to said first pair of roller means for enabling pivotal movement of said cutting means between an outermost inoperative position and an innermost cutting position relative to said first moving sheet of material.

21. The invention as defined in claim 20 and wherein said cutting means further comprising:

cutting blade means being located and positioned relative to said pivotal support means so as to be inclined relative to said first moving sheet of material in the cutting position in a direction forming an acute angle relative to the downstream portion of said first moving sheet of material.

22. The invention as defined in claim 16 and wherein, in the splicing positions of said first and second pair of roller means:

said first pair of spaced parallel axes of rotation of said first pair of roller means being located in a first plane extending at substantially a right angle to the path of movement of said first moving sheet of material therebetween; and said second pair of spaced parallel axes of rotation of said second pair of roller means being located in a second plane extending at substantially a right angle to the path of movement of said first moving sheet of material therebetween.

23. The invention as defined in claim 22 and wherein: said first plane and said second plane are substantially parallel.

24. The invention as defined in claim 23 and wherein: in the splicing positions of said first and second pairs of roller means said axes of rotation of said second pair of roller means are located in planes transverse to said second plane which are laterally offset to planes, including said axes of rotation of said first pair of roller means, transverse to said first plane.

25. The invention as defined in claim 19 and wherein: in the loading positions one side of said first moving sheet of material being supported only by said guide means and the other side of said first moving sheet of material being supported only by said one of said cylindrical outer peripheral surfaces of the associated one of said cylindrical outer peripheral surfaces of said second pair of roller means;

said second pair of roller means being movable from the loading position to the splicing position before movement of said first pair of roller means from the loading position to the splicing position; and said first pair of roller means being movable from the loading position to the splicing position after movement of said second pair of roller means from the loading position to the splicing position.

26. The invention as defined in claim 25 and wherein: the movement of said second pair of roller means from the loading position to the splicing position changing the direction of movement of said first moving sheet of material relative to said support surface of said splicing table means and increasing the spaced relationship therebetween.

27. The invention as defined in claim 26 and wherein: the movement of said first pair of roller means from the loading position to the splicing position further changing the direction of movement of said first moving sheet of material relative to said support surface of said splicing table means and increasing the spaced relationship therebetween.

28. The invention as defined in claim 27 and wherein:

in the splicing positions, the one surface of said first moving sheet of material being supportively engaged with said guide means, the other one of said first pair of roller means and the other one of said second pair of roller means, and the other surface of said first moving sheet of material being supportively engaged by said one of said first pair of roller means and said one of said second pair of roller means.

29. The invention as defined in claim 28 and wherein: in the splicing positions, said second sheet of material is supported by said one of said first pair of roller means and said support surface of said splicing table means and said one of said second pair of roller means.

* * * * *